United States Patent [19]

Gernhardt et al.

[11] 4,049,394

[45] Sept. 20, 1977

[54] CONTROL SYSTEM FOR A COAL GASIFICATION PLANT

[75] Inventors: Paul Gernhardt, Bochum; Wolfgang Grams, Wanne-Eickel; Wilhelm Danguillier; Siegfried Pohl, both of Bochum, all of Germany

[73] Assignee: Dr. C. Otto & Comp. G.m.b.H., Bochum, Germany

[21] Appl. No.: 746,244

[22] Filed: Dec. 1, 1976

[30] Foreign Application Priority Data

Dec. 4, 1975 Germany ..... 2554565

[51] Int. Cl.[2] ..... B01J 3/00; C10J 3/50

[52] U.S. Cl. ..... 48/62 R; 48/73; 48/83; 48/86 R; 214/18.2; 266/82; 302/53

[58] Field of Search ..... 48/62 R, 73, 76, 77, 48/83, 63, 87, 86 R, DIG. 4; 214/18.2, 17 CA; 302/53, 55, 59; 266/82

[56] References Cited

U.S. PATENT DOCUMENTS

| | | | |
|---|---|---|---|
| 2,630,373 | 3/1953 | Grossman | 48/62 R |
| 3,689,045 | 9/1972 | Coulter et al. | 302/53 |

*Primary Examiner*—Robert L. Lindsay, Jr.
*Assistant Examiner*—George C. Yeung
*Attorney, Agent, or Firm*—Brown, Murray, Flick & Peckham

[57] ABSTRACT

A control system maintains a predetermined volumetric ratio between fine-particle fuel and a gasification agent which are fed separately into a reactor wherein the fuel is gasified under pressure. The control system includes a first measuring means responsive to the absorption of electromagnetic radiation by the fine-particle fuel in a fuel-feed line for producing a fuel-feed signal corresponding to the volumetric amount of fuel conducted by the line. A vehicle gas-feed signal is produced by a second measuring means in response to the volumetric amount of vehicle gas conducted by a line into the fuel-feed line for admixture with the fuel therein. Computing means is responsive to the fuel-feed signal and the vehicle gas-feed signal to produce a control signal according the expression:

$$U_1 \cdot (U_2 - U_v)$$

for all values of $U_2$ greater than $U_v$ where $U_1$ corresponds to the reciprocal of the fuel-feed signal, $U_2$ corresponds to the vehicle gas-feed signal and $U_v$ is a predetermined comparison signal constant. Control valves respond to the control signal to vary the volumetric amount of fuel and gasification agent introduced into the reactor.

12 Claims, 1 Drawing Figure

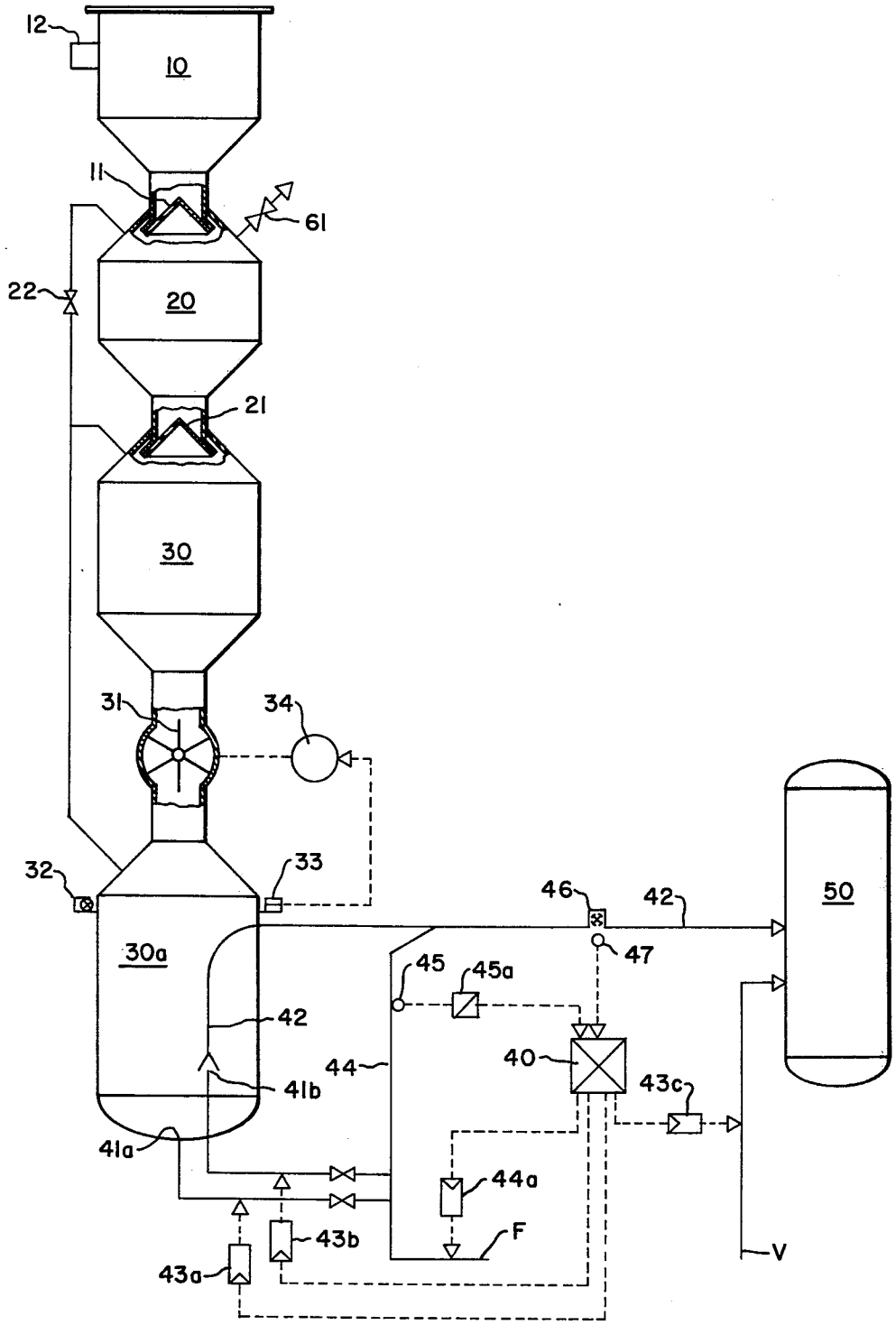
12
10
11
61
22
20
21
30
31
34
32
33
30a
46
42
47
50
45
45a
42
40
44
41b
43c
41a
44a
43b
F
43a
V

CONTROL SYSTEM FOR A COAL GASIFICATION PLANT

BACKGROUND OF THE INVENTION

This invention relates to a plant for the pressure gasification of fine-particle fuels wherein the fine-particle fuel in a pressure tank having a level controller is fed to the reactor together with a vehicle gas through a conduit; the fuel being fed by a fuel-feed conduit while a gasification agent is fed by another conduit in a predetermined volumetric ratio according to the amount of fuel supplied.

It is desirable to construct a gasification plant of this type for continuous operation. This includes continuous operation without any interruption due to changeover operations. The plant should include facilities to determine the volume of gas produced by the gasification process per unit of time. This volume of gas should be adjustable from a low value to a maximum value. The same is true in regard to the slag or other mass residue resulting from the gasification of fine-particle fuel in the reactor. The volume of gasification agent introduced into the reactor per unit of time should be at a predetermined volumetric ratio to the mass of fine-particle fuel introduced simultaneously into a reactor. The volume of gas corresponding to that ratio should be obtained automatically.

The system of conduits for the fuel and gas should contain interlocks to prevent only fine-particle fuel or only the gasification agent from entering into the reactor. The reactor for the gasification process may be of any well-known type, specifically, for example, a slag bath generator which includes a vessel with nozzles dispersed about the lower peripheral portion of a vertical reactor vessel for injecting a mixture of fine-particle coal and vehicle gas toward the bottom of the reactor shaft where a layer of slag is maintained by a slag overflow arranged centrally within the reactor shaft to discharge slag as it is continuously formed. A slag bath generator of this type is shown in copending application Ser. No. 684,112, assigned to the same Assignee as the present invention. As disclosed in this copending application, the slag bath generator is operated to gasify the coal at a temperature between 1500° C and 2200° C. Under normal operating conditions, a pressure of 25 atmospheres is maintained in the reactor shaft. Other details concerning the gasification process for pulverulent or fine-grain ash containing coal used as a fuel as disclosed in this copending application are exemplary of the operation of a slag bath generator which is the preferred form of the reactor for control by the control system of the present invention.

SUMMARY OF THE INVENTION

It is an object of the present invention to provide a control system to maintain a predetermined volumetric ratio between fine-particle fuel and a gasification agent during feeding thereof into a reactor for the gasification of the fuel.

In the present invention, there is provided a control system for an apparatus which includes a reactor to gasify fine-particle fuels under pressure, a main pressure tank having a level controller to maintain a desired fine-particle fuel level therein while such fuel and a partial quantity of vehicle gas are delivered therefrom by a fuel-feed conduit for introduction into the reactor, a vehicle-feed conduit coupled to the fuel-feed conduit for introducing the major portion of vehicle gas to convey the fine-particle fuel into the reactor, and conduit means to feed a gasification agent into the reactor, the combination therewith of a control system to maintain a predetermined volumetric ratio between the fine-particle fuel and gasification agent during feeding into the reactor, the control system comprising first measuring means responsive to the absorption of electromagnetic radiation by the fine-particle fuel in the fuel-feed line for producing a fuel-feed signal corresponding to the volumetric amount of fuel conducted by the fuel-feed line per unit of time, second measuring means responsive to the volumetric amount of vehicle gas conducted by the vehicle-feed conduit to produce a vehicle gas-feed signal, computing means responsive to the fuel-feed signal and the vehicle gas-feed signal to produce a control signal according to the expression:

$$U_1 \cdot (U_2 - U_v)$$

for all values of $U_2$ greater than $U_v$, where $U_1$ corresponds to the reciprocal of the fuel-feed signal, $U_2$ corresponds to the vehicle gas-feed signal and $U_v$ is a predetermined comparison signal constant, first control valve means responsive to the control signal to vary the volumetric amount of vehicle gas introduced into the pressure tank for loosening and discharging fine-particle fuel into the fuel-feed conduit, and second control valve means responsive to the control signal to vary the volumetric amount of gasification agent fed by the conduit means into the reactor.

Thus, according to the present invention, the fuel-feed conduit contains a system for measuring the fine-particle fuel present in a specific cross section of the conduit. The measuring system being based on the principle of absorption of electromagnetic radiation by the fuel, and the measuring system is connected to a process computer which forms a reciprocal $U_1$ to the voltage value $u_1$ obtained in the measuring system. The conduit for supplying the major proportion of the vehicle gas contains a system for measuring the volumetric amount of gas per unit of time conducted thereby. The latter measuring system transmits a measured voltage value $U_2$ to the process computer. The computer is so constructed that it produces a predetermined comparison voltage $U_v$ and forms a difference signal by the expression:

$$U_2 - U_v$$

and a signal corresponding to the product $$U_1 \cdot (U_2 - U_v)$$

for all values of $U_2$ greater than $U_v$. The computer forms a control signal corresponding to the value of the product $$U_1 \cdot (U_2 - U_v)$$

to control a value in a conduit line for adjusting the proportion of vehicle gas employed to loosen the fuel in the pressure tank. The control signal further controls a valve for a conduit line to adjust the quantity of vehicle gas employed to discharge the fuel from the pressure tank into the fuel-feed line, and finally, the control signal is employed to adjust a valve for controlling the supply of gasification agent fed into the reactor.

The comparison voltage $U_v$ is equivalent to a minimum gas velocity in the pipe conveying the fine-particle fuel such that it is possible for the fine-particle fuel to be conveyed in the form of a fluidized flow. The reactor can be operated in practice only above a vehicle gas velocity corresponding to the comparison voltage $U_v$.

The control system operates to control the fuel and the gasification agent which are supplied to the reactor by employing a pressure tank in which an adequate volume of fine-particle fuel is always maintained by employing a level controller. According to a preferred aspect of the invention, a further pressure tank is provided above the main pressure tank from which the fine-particle fuel is conveyed to the reactor. The additional pressure tank is filled in a manner which is known per se in the art through the agency of a lock tank located upstream thereof. The fine-particle fuel fed from this additional pressure tank is quantitatively controlled by a system which includes, for example, a bucket wheel controlled by the level controller of the main pressure tank.

As described hereinbefore, the measuring system for the fine-particle fuel in the conduit system is based on electromagnetic radiation and in one form, the measuring system includes a light-permeable tube segment in the fuel-feed line with a light source at one side and a photoelectric cell oppositely disposed thereto. Alternatively, the measuring system may be in the form of a radioactive emitter and detector associated with the fuel-feed line. In still another form, the measuring system may take the form of means for coupling a high-frequency oscillator and a measuring system for detecting the amount of oscillation energy absorbed by the fine-particle fuel in the feed line. The invention further contemplates that the measuring system consists of more than one or even all of the aforementioned forms of measuring devices to provide the fuel-feed signal for use in the control system.

The process computer employed in the present invention may be used to monitor a number of fuel-feed conduits and vehicle gas conduits. A number of fuel-feed conduits may be coupled to a single pressure tank. Thus, it is desirable to provide a plurality of valves for the various conduit lines associated with the fuel-feed conduits.

The features and advantages of the present invention are particularly applicable to a pressurized slag bath generator as discussed hereinbefore. A slag bath generator of the type particularly suitable is constructed as a cylindrical shaft with a wall through which nozzles extend for introducing the fine-particle fuel and gasification agent as a fluidized flow. A slag bath generator of this type is operated at temperatures at which the slag occurs in liquid form. The bottom of the generator is provided with an annular trough in which the liquid slag collects and is discharged through a centrally-arranged aperture in the base of the cylindrical shaft. The direction at which the jets of fluidized fuel and gasification agent pass from the nozzles is advantageously directed at an angle to the surface of the bath so that the slag undergoes a circular motion with a net slag movement directed toward the central aperture whereby movement of slag into the overflow is assisted. Such an arrangement of parts is specifically disclosed in copending application Ser. No. 735,180, assigned to the same Assignee as the present invention.

These features and advantages of the present invention as well as others will be more fully understood when the following description is read in light of the accompanying drawing which illustrates diagrammatically the control system of the present invention for a plant to gasify fine-particle fuels.

The diagrammatic illustration in the drawing includes a reactor 50 which may, for example, be a slag bath generator operated under a pressure as noted previously. Reference character F denotes a supply line for vehicle gas for admixture with the fine-particle fuel typically, for example, fine-particle coal, for introduction as fluidized flow into the reactor 50. Reference character V denotes a supply line for a gaseous gasification agent, typically, for example, oxygen.

A reservoir 10 receives fine-particle fuel from a feed line 12. A pressure lock 11 is open to pass the fuel from reservoir 10 into a lock tank 20. A pressure lock 21 is opened to pass the fine-particle fuel from the lock tank 20 into a pressure tank 30. A main pressure tank 30A receives a controlled discharge of the fine-particle fuel by a bucket wheel 31 from the pressure tank 30. The fine-particle fuel is always conveyed to the reactor from the pressure tank 30A. The tank 30 is always pressurized and disposed upstream of tank 30A. Lock tank 20, upstream of pressure tank 30, is depressurized for filling purposes and pressurized when discharging its filling of fine-particle fuel into the pressure tank 30. The pressure locks 11 and 21 and valves 22 and 61 are operated alternatively for depressurizing and pressurizing during filling and emptying of the lock tank 20.

The bucket wheel 31 is provided in a conduit line extending between pressure tanks 30 and 30A in order to convey the fine-particle fuel into pressure tank 30A in small batches. Tank 30A includes a level controller formed by a sender 32 and a receiver 33, the latter providing an output signal which is used to operate a drive 34 coupled to the bucket wheel 31. The bucket wheel insures the quantitatively controlled supply of fine-particle fuel so that the pressure tank 30A is always maintained in an essentially-filled state whereby the quantity of fine-particle fuel contained therein fluctuates only within narrow limits.

Tank 30A contains a fluidized bed which is known per se in the art. Some of the vehicle gas is fed into tank 30A by line 41A to create a turbulent motion in the fine-particle fuel therein. Another partial stream of vehicle gas is delivered to an injector 41B situated inside the tank 30A for injecting or directing fine-particle fuel into pipe 42 which is the fuel-feed line. The main flow of vehicle gas in conducted by line 44 for delivery into pipe 42 at a point outside the pressure tank 30 and upstream of a fuel measuring device. The fuel measuring device essentially consists of an emitter 46 and a detector 47 shown diagrammatically. The operation of this measuring device is based on the principle of absorption of electromagnetic radiation by the fine-particle fuel conveyed through pipe 42. As described hereinbefore, light sources and photoelectric cells or radioactive sources and counting tubes may be used to form the emitter 46 and detector 47, respectively. The applied principle of measurement may alternatively include coupling a high-frequency oscillator so that the energy of the high-frequency waves is absorbed by the fine-particle fuel and the absorption of this energy is detected by a measuring device.

Also, as stated hereinbefore, a number of the different forms of measuring devices is advantageously combined to enable the measurement of the volumetric flow of fine-particle fuel in the fuel-delivery pipe 42 even when the flow of fuel is at a very low or a very high density and to cover a wide range of measurement. An electrical signal $U_1$ is delivered by detector 47. This signal is inversely proportional to the mass flow rate of fine-particle fuel in the cross section of the fuel-feed line at the point of measurement. The signal $U_1$ is fed to a process computer 40 which initially forms the reciprocal $U_1$ according to the relation:

$$U_1 = 1/u_1.$$

The signal $U_1$ formed by the reciprocal in the computer is a measurement of the solid density within the measured section of the fuel-feed line, but the signal does not denote any information as to whether the solid particles are in motion or at rest. To insure that the particles are in motion, it is necessary to supply a specific quantity of injected vehicle gas from line 44.

Line 44 contains a restrictor 45 which is a measuring device that provides an output signal converted to a voltage signal $U_2$ by a transmitter 45A. The $U_2$ voltage signal is also fed to the process computer 40. A comparative voltage signal $U_v$ is then selected. The selection of the value of voltage signal $U_v$ is based on the equivalent of a velocity in the fuel conveying pipe 42 so as to insure a practically fluidized conveying of the fine-particle fuel. The position of the valve for the flow of vehicle gas is so selected by means of a control 44A situated in a connecting line between the computer 40 and the vehicle gas-feed line such that the value of voltage signal $U_2$ is equal to the value of voltage signal $U_v$.

The computer forms the product according to the expression $$U_1 \cdot (U_2 - U_v)$$

for all values of $U_2$ greater than $U_v$. This product forms a reference value or control signal for adjusting valves 43A, 43B and 43C. Valve 43A controls the proportion of vehicle gas fed to the bottom of the pressure tank 30A which is used to fluidize the fine-particle fuel in this tank. Valve 43B controls that portion of the vehicle gas which is intended to actuate the injector 41B and thereby determines the amount of fine-particle fuel discharged from the pressure tank 30A. The valve 43C is situated in the line V which delivers the gasification agent to the reactor 50.

The product of the expression $$U_1 \cdot (U_2 - U_v)$$

assumes a value of zero when either $U_1$ or $(U_2 - U_v)$ assumes a value of zero. This means that the supply of gasification agent is switched OFF if there is any interruption in the supply of fine-particle fuel or vehicle gas.

When the gasification plant is started up, all the valves 43A, 43B and 43C remain closed until the value of the signal $U_2$ reaches the value of the voltage signal $U_v$ so that initially only vehicle gas is fed into the reactor. These valves are opened only when the value of voltage signal $U_2$ has reached the value of voltage signal $U_v$.

The above control system may be connected in parallel in a reactor wherein a number of nozzles is provided for supplying the fine-particle fuel to the reactor. Only one process computer is required in such cases to compare and standardize the delivery of the media by the individual systems. A common pressure tank 30A may be employed when a number of nozzles is provided to introduce the fine-particle fuel and the gasification agent into the reactor and, in such case, the number of delivery pipes 42 will be provided with an equivalent number of nozzles.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In an apparatus including a reactor to gasify fine-particle fuels under pressure, a main pressure tank having a level controller to maintain a desired fine-particle fuel level therein while such fuel and a partial quantity of vehicle gas are delivered therefrom by a fuel-feed conduit for introduction into said reactor, a vehicle-feed conduit coupled to said fuel-feed conduit for introducing the major portion of vehicle gas to convey said fine-particle fuel into said reactor, and conduit means to feed a gasification agent into said reactor, the combination therewith of a control system to maintain a predetermined volumetric ratio between said fine-particle fuel and said gasification agent during feeding into said reactor, said control system comprising:

first measuring means responsive to absorption of electromagnetic radiation by said fine-particle fuel in said fuel-feed line for producing a fuel-feed signal corresponding to the volumetric amount of fuel conducted by said fuel-feed line per unit of time, second measuring means responsive to the volumetric amount of vehicle gas conducted by said vehicle-feed conduit to produce a vehicle gas-feed signal, computing means responsive to said fuel-feed signal and said vehicle gas-feed signal to produce a control signal according to the following expression $$U_1 \cdot (U_2 - U_v)$$

for all values of $U_2$ greater than $U_v$, where $U_1$ corresponds to the reciprocal of said fuel-feed signal, $U_2$ corresponds to said vehicle gas-feed signal, and $U_v$ is a predetermined comparison signal constant, first control valve means responsive to said control signal to vary the volumetric amount of vehicle gas introduced into said pressure tank for loosening and discharging fine-particle fuel into said fuel-feed conduit, and second control valve means responsive to said control signal to vary the volumetric amount of gasification agent fed by said conduit means into said reactor.

2. The control system according to claim 1 wherein said apparatus further includes a second pressure tank disposed above said main pressure tank and coupled thereto by fuel delivery control means for introducing fine-particle fuel from said second pressure tank into said main pressure tank, said level controller being operatively coupled to said fuel delivery control means to quantitatively control the passage of fine-particle fuel into said pressure tank for maintaining the desired fine-particle fuel level therein.

3. The control system according to claim 1 wherein said first measuring means includes a light-permeable tube segment forming part of said fuel-feed line, a light source at one side of said light-permeable tube segment, and a photoelectric cell at the side of said light-permeable tube segment opposite said light source.

4. The control system according to claim 1 wherein said first measuring means includes a radioactive emitter, and a counting tube aligned at opposite sides of said fuel-feed line.

5. The control system according to claim 1 wherein said first measuring means includes a high-frequency oscillator coupled to said fuel-feed line, and means to measure the absorption of energy of said oscillator by said fine-particle fuel.

6. The control system according to claim 1 wherein said first measuring means includes a plurality of measuring means to produce said fuel-feed signal.

7. The control system according to claim 6 wherein said plurality of measuring includes a light-permeable tube segment forming part of said fuel-feed tube, a light source at one side of said light-permeable tube segment, and a photoelectric cell at the side of said light-permeable tube segment opposite said light source.

8. The control system according to claim 6 wherein said plurality of measuring means includes a radioactive emitter and a counting tube aligned at opposite sides of said fuel-feed line.

9. The combination system according to claim 6 wherein said plurality of measuring means includes a high-frequency oscillator coupled to said fuel-feed line, and means to measure the absorption of energy of said oscillator by said fine-particle fuel.

10. The control system according to claim 1 wherein said fuel-feed conduit and said conduit means each includes a plurality of conduit pipes, separate first valves defining said first control valve means being coupled in each conduit pipe forming the fuel-feed conduit, separate second valves defining said second control valve means being coupled in each conduit pipe forming said conduit means.

11. The control system according to claim 10 wherein the conduit pipes defining said fuel-feed conduit are each coupled to a unitary pressure tank defined by said main pressure tank.

12. The control system according to claim 1 wherein said first control valve means includes two valves with separate feed lines, one feed line extending into said pressure tank to loosen fine-particle fuel therein, and the other feed line extends toward the entry end of said fuel-feed conduit to direct fine-particle fuel thereto.

* * * * *